US007132131B2

(12) United States Patent
Böttger et al.

(10) Patent No.: US 7,132,131 B2
(45) Date of Patent: Nov. 7, 2006

(54) METHOD FOR PRODUCING A HYDROPHOBICALLY FINISHED ARAMID FABRIC AND USE THEREOF

(75) Inventors: Christian Kurt Böttger, Remscheid (DE); Rüdiger Hartert, Wuppertal (DE); Kurt Rainer Stolze, Leichlingen (DE); Jan Jager, Duiven (NL); Henk van de Ven, Arnhem (NL); Peter Gerard Akker, Doetinchem (NL)

(73) Assignee: Teijin Twaron GmbH, Wuppertal (DE)

( * ) Notice: Subject to any disclaimer, the term of this patent is extended or adjusted under 35 U.S.C. 154(b) by 142 days.

(21) Appl. No.: 10/656,188

(22) Filed: Sep. 8, 2003

(65) Prior Publication Data

US 2004/0142617 A1 Jul. 22, 2004

(30) Foreign Application Priority Data

Sep. 6, 2002 (EP) ..... 02020025

(51) Int. Cl.
*B05D 3/02* (2006.01)

(52) U.S. Cl. ..... 427/379; 427/381

(58) Field of Classification Search ..... 427/379, 427/381, 389.9, 394
See application file for complete search history.

(56) References Cited

U.S. PATENT DOCUMENTS

| | | | | |
|---|---|---|---|---|
| 3,462,296 | A * | 8/1969 | Tandy, Jr. et al. | 427/381 |
| 3,671,542 | A * | 6/1972 | Kwolek | 524/157 |
| 4,107,368 | A * | 8/1978 | Ratcliffe et al. | 442/187 |
| 4,232,087 | A | 11/1980 | Trask | |
| 4,623,574 | A | 11/1986 | Harpell et al. | |
| 4,737,402 | A | 4/1988 | Harpell et al. | |
| 4,916,000 | A | 4/1990 | Li et al. | |
| 5,116,682 | A | 5/1992 | Chakravarti et al. | |
| 5,225,241 | A * | 7/1993 | Dischler | 427/121 |
| 5,229,199 | A * | 7/1993 | Miner et al. | 442/135 |
| 5,354,605 | A | 10/1994 | Lin et al. | |
| 5,501,879 | A * | 3/1996 | Murayama | 427/381 |
| 6,660,336 | B1 * | 12/2003 | Frenken et al. | 427/379 |

FOREIGN PATENT DOCUMENTS

| | | | |
|---|---|---|---|
| EP | 191306 | * | 9/1986 |
| EP | 620410 | * | 10/1994 |
| EP | 1396698 | * | 3/2004 |
| JP | 56-140181 | * | 11/1981 |
| WO | WO89/06190 | * | 7/1989 |
| WO | WO 92/01108 | * | 1/1992 |
| WO | WO 93/00389 | * | 1/1993 |
| WO | WO 95/04854 | | 2/1995 |
| WO | WO 00/42246 | * | 7/2000 |

OTHER PUBLICATIONS

Textile Month, p. 9 and 11, Apr. 1984.*
Research Disclosure, 305, pp. 649-650, 1989.*
Witczak et al, Fibres and Textiles in Eastern Europe, 4/3-4, pp. 139-142, 1996.*
Vigneswaran, Synthetic Fibres, 33/4, pp. 24-28, 2004.*
Jakob et al, Technische Textilien, 41(3), E48, 1 page, Sep. 1998.*
Abstract and full text of Jakob et al, Technische Textilien, 41(3), p. E48, 1998.*

* cited by examiner

*Primary Examiner*—Erma Cameron
(74) *Attorney, Agent, or Firm*—Oliff & Berridge, PLC

(57) ABSTRACT

A method for producing a hydrophobically finished aramid fabric includes at least
a) providing an aramid yarn,
b) applying a water-repellent agent to the aramid yarn,
c) drying the aramid yarn resulting from step b),
d) producing a fabric from the aramid yarn resulting from step c), and
e) heat treating the fabric. The fabric is used to produce an antiballistically effective article.
The $v_{50}$ values for the hydrophobically finished fabrics of the invention are in the wet state higher than, and in the dry state at least as high as or higher than, the values for hydrophobically finished fabrics not of the invention in the wet and dry states, respectively.

15 Claims, No Drawings

METHOD FOR PRODUCING A HYDROPHOBICALLY FINISHED ARAMID FABRIC AND USE THEREOF

BACKGROUND OF THE INVENTION

1. Field of Invention

The present invention relates to a method for producing a hydrophobically finished aramid fabric and the use thereof.

2. Description of Related Art

Hydrophobically finished aramid fibers and fabrics and methods for producing them are known.

WO 95/04854 describes a process for plasma treatment of antiballistically effective materials such as aramids whereby, in a first step, plasma treatment is carried out with ≧50% of an inorganic gas or a mixture of inorganic gases and, in a second step, with a hydrophobically acting organic gas or with a mixture of such gases from the group of saturated hydrocarbons, unsaturated hydrocarbons, saturated fluorocarbons, unsaturated fluorocarbons, siloxanes and vinyl compounds, in the presence of one or more inorganic gases if required.

U.S. Pat. No. 4,232,087 discloses the coating of aramid fibers and/or aramid fabrics (e.g., Nomex fibers) with an aqueous dispersion of polytetrafluoroethylene particles and a water-soluble coordination complex of chromium with a fluoro-substituted hydrocarbon compound containing amino-substituted and sulfonylamino-substituted alkyl groups having ≧6 carbon atoms. The treated fabric is dried, after which crosslinking is advantageously effected by heat treatment.

WO 92/01108 describes the coating of aramid fibers with an aqueous fluoropolymer dispersion, which is applied to the fiber either in the wet or the dried state, whereby, preferably, the wet, never-dried fiber is immersed in a coating bath containing the fluoropolymer dispersion. The coated fiber is then dried, during which the coating on the fiber surface is crosslinked.

U.S. Pat. No. 5,116,682 describes the production of anti-wicking and water-repellent heat-stable yarns, such as polyester yarns or yarns made from glass, nylon or aramid. The yarn is coated with a fluorocarbon emulsion or dispersion, dried and then crosslinked by heat.

Aramid fabrics are known to show high antiballistic efficiency in the dry state. However, the antiballistic efficiency is considerably reduced when the fabric is in the wet state. Aramid fabrics are therefore often given a hydrophobic finish. It has been shown, however, that aramid fabrics provided with a hydrophobic finish by the known methods nevertheless show a significant reduction in their protective antiballistic efficiency when they are wet.

SUMMARY OF THE INVENTION object of the present invention, therefore, is to provide a method of producing a hydrophobically finished aramid fabric with good antiballistic efficiency even in the wet state.

Moreover, the antiballistic efficiency in the dry state of the hydrophobically finished aramid fabric produced by the method of the invention should be at least as high as, and if possible even higher than, that in the dry state of a hydrophobically finished aramid fabric produced by known methods.

A further object of the present invention is therefore to provide a method of producing a hydrophobically finished aramid fabric, the antiballistic efficiency of which is good even in the dry state.

These objects are achieved with a method for production of a hydrophobically finished aramid fabric, comprising at least the following steps:

a) providing an aramid yarn,
b) applying a water-repellent agent to the aramid yarn,
c) drying the aramid yarn resulting from step b),
d) producing a fabric from the aramid yarn resulting from step c), and
d) heat treating the fabric.

DETAILED DESCRIPTION OF PREFERRED EMBODIMENTS

The method of the invention surprisingly provides hydrophobically finished aramid fabrics, of which the antiballistic efficiency in the wet state is higher than for a hydrophobically finished aramid fabric produced by known methods in the wet state.

Moreover, the method of the invention also surprisingly provides hydrophobically finished aramid fabrics, of which the antiballistic efficiency in the dry state is at least as high as, and in some embodiments even higher than, that for a hydrophobically finished aramid fabric produced by known methods in the dry state.

In step a) of the method of the invention, the aramid yarn can be provided by, for example, unwinding the yarn from a bobbin, after which the yarn can be moistened by an agent facilitating absorption of the water-repellent agent in step b) of the method of the invention. In another embodiment of the method of the invention, the aramid yarn is provided in the spinning process after having left the wash bath, whereby the yarn is in the moist state and the moisture consists essentially of water and—depending on the efficiency of the previous washings—varying small proportions of sulfuric acid. This embodiment of the method of the invention represents only a small increase in cost in relation to the overall cost for the entire aramid yarn spinning process, and is therefore preferred.

In the context of the present invention, the term "aramid yarn" denotes a yarn whose fiber-forming substance is a long-chain synthetic polyamide in which at least 85% of the amide bonds are directly linked to two aromatic rings. In step a) of the method of the invention, a particularly preferred aramid yarn is one produced from poly(p-phenylene terephthalamide), particularly a yarn designated as TWARON® and available from Teijin Twaron for which a titer in the range 200–5000 dtex, and particularly in the range 550–3360, is preferred, and which consists preferably of 100–3000 fibers and particularly preferably of 500 to 2000 fibers.

In the context of the present invention, the term "yarn" denotes a linear textile structure made from the fiber-forming substance defined above, such as staple fiber yarn, twisted staple fiber yarn, twisted filament yarn, untwisted tangled yarn (also known as interlaced yarn), and preferably untwisted filament yarn.

The water-repellent agent in step b) of the method of the invention can in principle be any agent that repels water and that can be applied to the aramid yarn, an agent comprising fluorine and carbon atoms being preferred.

The preferred water-repellent agent used in step b) of the method of the invention is one comprising a fluoropolymer, and especially a mixture of fluoroacrylate polymers, e.g., OLEOPHOBOL SM® from Ciba Spezialitätenchemie Pfersee GmbH, Langweid, Germany.

The water-repellent agent may in addition contain an antistatic agent, such LEOMIN AN® from CLARIANT GmbH, Textile Leather Products Division, Textile Chemicals BU, Frankfurt Main, Germany.

In a further embodiment of the method of the invention, the water-repellent agent also contains a lubricant, whereby the preferred lubricant is a mixture of 1,3-dihydroxyalkyl-5,5-dialkyl hydantoin and an ester of oleic acid and ethylene oxide, and a particularly preferred lubricant is a mixture of 1,3-dihydroxyethyl-5,5-dimethyl hydantoin and an ester of 1 mol of oleic acid and 17 mol of ethylene oxide, because the formation of deposits on static thread-guiding elements is then inhibited. A mixture of this type is available under the name of HYMO 90 from Goulston Technologies, Inc., Monroe, NC, USA.

The water-repellent agent applied on the aramid yarn in step b) of the method of the invention can be used in pure form, provided it satisfies the above-mentioned criteria. On account of easier dosing of the required amount of water-repellent agent on to the yarn, however, it is advantageous, in step b) of the method of the invention, to apply the water-repellent agent to the aramid yarn in the form of a solution or dispersion or preferably an aqueous emulsion, the water-repellent agent being present in the aqueous emulsion preferably in a concentration in the range of 20–300 g/l.

For application of the water-repellent agent to the aramid yarn in step b) of the method of the invention, any method is suitable in principle that allows the water-repellant agent in the chosen formulation to be uniformly distributed on the surface of the yarn. For example, the water-repellent agent formulation can be applied as a thin film on a roller and the aramid yarn passed through the film. Alternatively, the water-repellent agent formulation can be sprayed on to the aramid yarn. The water-repellent agent formulation can also be applied to the yarn using a pump and a pin, slit or block applicator.

The application in step b) of the method of the invention is effected preferably by passing the aramid yarn over a roller immersed in a bath containing the aqueous emulsion of the water-repellent agent, the emulsion preferably having a temperature in the range 15–35° C.

The drying of the aramid yarn in step c) of the method of the invention is performed within ranges of temperature and of drying time that suffice to ensure that the aramid yarn resulting from step b) does not agglutinate in the subsequent winding up. The parameter ranges for temperature and drying time are also determined by the requirements of the selected application method in step b) of the method of the invention. If the water-repellent agent is applied on the aramid yarn in the aramid yarn spinning process, for example, after the yarn has left the wash bath, the ranges of temperature and drying time will be determined by the spinning speed and the structural features of the spinning facility. If the aramid yarn resulting from step b) is dried at a temperature in the range of 130–210° C. and for a period in the range of 5–15 seconds, the drying yields excellent results, for which reason the above-mentioned ranges are preferred.

In the method of the invention, the aramid yarn resulting from step c) is used in step d) to produce a fabric, preferably in plain weave, especially a fabric with a thread count in warp and weft in the range of 3–20 threads/cm.

In step e) of the method of the invention, the fabric obtained in step d) is heat treated, preferably until the water absorption of the fabric is reduced. The ranges of duration and temperature required for the heat treatment are determined essentially by the water-repellent agent applied in step b). In many cases a temperature in the range of 120–200° C. and a duration of 30–120 seconds are adequate for heat treatment.

A proportion of water-repellent agent in the range of 0.001–0.02 g of water-repellent agent per g of fabric, and particularly of 0.006–0.015 g of water-repellent agent per g of fabric, after step e) of the method of the invention results in particularly high hydrophobic efficiency coupled with high antiballistic efficiency in the dry and wet states.

The objects of the invention are further achieved with an aramid fabric hydrophobically finished by the method of the invention, which, as the following examples show, can advantageously be used for production of antiballistically effective articles such as bullet-proof vests and helmets.

Example 1

OLEOPHOBOL SM® from Ciba Spezialitatenchemie Pfersee GmbH, Langweid am Lech, Germany, is used as the water-repellent agent. OLEOPHOBOL SM® is an aqueous emulsion comprising fluoroacrylate polymers and non-ionic/cationic tensides, the proportion of fluoroacrylate polymers and of fluorine being respectively 19.5% and 5.3% by weight. The finishing agent to be applied to the aramid yarn was prepared by adding to 74 parts by weight of demineralized water, 25.5 parts by weight of OLEOPHOBOL SM® and 0.25 parts by weight of LEOMIN AN® from CLARIANT GmbH, Textile Leather Products Division, Textile Chemicals BU, Frankfurt Main, Germany, so that the finishing agent contains 5.0% by weight of fluoroacrylate polymers.

Application of the finishing agent thus obtained on TWARON® yarn of type 2000 (930 dtex f1000) from Teijin Twaron is integrated into the spinning process. After leaving the wash bath, the aramid yarn moves at a speed of 325 m/min over a rotating roller immersed in a bath containing the finishing agent that has been produced as described above. The aramid yarn treated with the finishing agent next passes through a drying zone, where the yarn is dried at a temperature of 170° C. for 10 seconds. The yarn is then wound up.

The aramid yarn is subsequently woven into a plain weave fabric (9.4 threads/cm in warp and weft, 180 g/m$^2$, fabric structure I).

The fabric is finally exposed to a temperature of 170° C. for 90 seconds. The fabric then contains 0.01 g of water-repellent agent per g of fabric.

Comparison Example 1a

An aramid fabric of fabric structure I made of TWARON® yarn of type 2000 (930 dtex f1000) from Teijin Twaron is padded with a finishing agent prepared by adding 60 parts by weight of OLEOPHOBOL SM® to 40 parts by weight of demineralized water.

The aramid fabric is fed through a bath containing the finishing agent prepared as described above, and on leaving the bath is squeezed by a pair of rollers such that the liquor uptake is 35% by weight. The fabric is then exposed to a temperature of 170° C. for 90 seconds, after which it contains 0.042 g of water-repellent agent per g of fabric.

Example 2

Example 2 is carried out as for Example 1, except that the yarn used is TWARON® yarn of type 2000 from Teijin Twaron (930 dtex f1000) and that a plain weave fabric (10.5 threads/cm in warp and weft, 200 g/m$^2$) is produced (fabric structure II). The fabric then contains 0.01 g of water-repellent agent per g of fabric.

Comparison Example 2a

The finishing agent described in Example 1 is applied, as described in that example, on the TWARON® yarn of Example 2, and the yarn is exposed to a temperature of 170° C. for 10 seconds. The yarn treated in this way is then used to produce a fabric of fabric structure II containing 0.01 g of water-repellent agent per g of fabric.

Comparison Example 2b

A fabric of fabric structure II made from the TWARON® yarns of Example 2 is padded as described in Comparison Example 1a using the finishing agent described in that example. The fabric is exposed to a temperature of 170° C. for 90 seconds. The fabric then contains 0.042 of water-repellent agent per g of fabric.

Example 3

OLEOPHOBOL SL® from Ciba Spezialitätenchemie Pfersee GmbH, Langweid (Lech), Germany, is used as the water-repellent agent. OLEOPHOBOL SL® is an aqueous emulsion comprising fluoroacrylate polymers and non-ionic/cationic tensides, the proportion of fluoroacrylate polymers and of fluorine being respectively 20.0% and 5.6% by weight. The finishing agent to be applied to the aramid yarn was prepared by adding to 73.25 parts by weight of demineralized water, 25 parts by weight of OLEOPHOBOL SL®, 0.25 parts by weight of LEOMIN AN® from CLARIANT GmbH, Textile Leather Products Division, Textile Chemicals BU, Frankfurt Main, Germany, and 2.5 parts by weight of HYMO 90 from Goulston Technologies, Inc., Monroe, NC, USA, so that the finishing agent contains 5.0% by weight of fluoroacrylate polymers.

Application of the finishing agent thus obtained on TWARON® yarn of type 2000 (930 dtex f1000) from Teijin Twaron is integrated into the spinning process. After leaving the wash bath, the aramid yarn moves at a speed of 325 m/min over a rotating roller immersed in a bath containing the aqueous finishing agent that has been produced as described above. The aramid yarn treated with the finishing agent next passes through a drying zone where the yarn is dried at a temperature of 170° C. for 10 seconds. The yarn is then wound up.

The aramid yarn is subsequently woven into a plain weave fabric (9.4 threads/cm in warp and weft, 180 g/m$^2$, fabric structure I).

The fabric is finally exposed to a temperature of 170° C. for 90 seconds. It then contains 0.01 g of water-repellent agent per g of fabric.

Testing Procedures

Antiballistic Efficiency

The antiballistic efficiency was determined by measurement of the $v_{50}$ value of a fabric package consisting of 15 layers (Example 1 and Comparison Example 1a) or 14 layers (Examples 2 and 3, and Comparison Examples 2a and 2b) using test method STANAG 2920 (1.1 g splinter). The $v_{50}$ value thus determined signifies the projectile speed at which half of the projectiles are stopped by the fabric package and the other half fully penetrate it.

Before measurement of $v_{50}$ in the dry state, the fabric package was conditioned in the ISO 139 standard atmosphere, i.e., for 24 hours at 20±2° C. and relative humidity 65±2%.

Before the measurement of $v_{50}$ in the wet state, the fabric package was immersed in water for 1 hour and the water then allowed to drip off for 3 minutes.

Hydrophobic Efficiency

The hydrophobic efficiency was measured by measuring the water absorption of a fabric package consisting of 15 layers (Example 1 and Comparison Example 1a) or 14 layers (Examples 2 and 3, and Comparison Examples 2a and 2b). The dry fabric package was weighed (=$w_1$) and immersed in water for 1 hour; the water was then allowed to drip off for 3 minutes and the package reweighed (=$w_2$); the water absorption W, expressed as a percentage, was then calculated from the expression $$W=[(w_2/w_1)-1]\cdot 100[\%]$$

In Example 3, the hydrophobic efficiency was also measured by the Bundesmann water repellency test (ISO 9865). The water absorption determined after 10 minutes by this method is marked with a * in the table below.

The antiballistic and hydrophobic efficiency of the hydrophobically finished fabric of the invention (Examples 1 to 3) and of hydrophobically finished fabric not of the invention (Comparison Examples 1a, 2a and 2b) are shown in the table below.

The table indicates that for the hydrophobically finished fabric of the invention, the $v_{50}$ values are higher in every case in the wet state, and at least as high, or higher, in the dry state than for hydrophobically finished fabrics not of the invention.

TABLE

| Example | Fabric structure | Application of water-repellent agent | $v_{50}$ dry m/s | $v_{50}$ wet m/s | W % |
|---|---|---|---|---|---|
| 1 | I | Coating of yarn<br>Drying of yarn<br>Production of fabric<br>Heat treatment of fabric | 500 | 477 | 21 |
| 1a | I | Coating of fabric<br>Heat treatment of fabric | 480 | 467 | 26.6 |
| 2 | II | Coating of yarn<br>Drying of yarn<br>Production of fabric<br>Heat treatment of fabric | 480 | 458 | 21 |
| 2a | II | Coating of yarn<br>Drying of yarn<br>Production of fabric | 480 | 383 | 27.7 |
| 2b | II | Coating of fabric<br>Heat treatment of fabric | 478 | 453 | 21.5 |
| 3 | I | Coating of yarn<br>Drying of yarn<br>Production of fabric<br>Heat treatment of fabric | 500 | 469 | 29.8<br>22.2* |

What is claimed is:

1. A method for producing a hydrophobically finished aramid fabric, comprising at least the steps a) providing an aramid yarn, b) applying a water-repellent agent to the aramid yarn, wherein the water-repellent agent is an agent comprising a mixture of fluoroacrylate polymers, c) drying the aramid yarn resulting from step b), d) forming a fabric from the aramid yarn resulting from step c), and e) heat treating the fabric.

2. Method according to claim 1, in step a), the aramid yarn is provided by a spinning process after leaving a wash bath.

3. Method according to claim 1, wherein the aramid yarn is produced from poly(p-phenylene terephthalamide).

4. Method according to claim 1, wherein the water-repellent agent further includes an antistatic agent.

5. Method according to claim 1, wherein the water-repellent agent further includes a lubricant.

6. Method according to claim 1, wherein in step b), the water-repellent agent is applied to the aramid yarn as an aqueous emulsion.

7. Method according to claim 6, wherein in step b), the water-repellent agent is present in the aqueous emulsion in a concentration in the range of 20–300 g/l.

8. Method according to claim 6, wherein in step b), the application of the water-repellent agent comprises passing the aramid yarn over a roller immersed in a bath containing the aqueous emulsion of the water-repellent agent.

9. Method according to claim 8, wherein in step b), the aqueous emulsion has a temperature in the range of 15–35° C.

10. Method according to claim 1, wherein in step c), the aramid yarn resulting from step b) is dried at a temperature in the range of 130–210° C.

11. Method according to claim 10, wherein in step c), the drying time of the aramid yarn resulting from step b) is in the range of 5–15 seconds.

12. Method according to claim 1, wherein in step d), a plain weave fabric is produced.

13. Method according to claim 1, wherein in step e), the heat treatment is carried out in the temperature range of 120–200° C.

14. Method according to claim 13, wherein in step e), the heat treatment is carried out for a duration of 30–120 seconds.

15. Method according to claim 1, wherein after step e), the fabric contains 0.001–0.02 g of water-repellent agent per g of fabric.

* * * * *